US007690534B2

(12) United States Patent
Revenu

(10) Patent No.: US 7,690,534 B2
(45) Date of Patent: Apr. 6, 2010

(54) DEVICE FOR PLACING TWO PRODUCTS IN CONTACT

(75) Inventor: Christian Revenu, Livry-Gargan (FR)

(73) Assignee: L'Oreal, Paris (FR)

( * ) Notice: Subject to any disclaimer, the term of this patent is extended or adjusted under 35 U.S.C. 154(b) by 1014 days.

(21) Appl. No.: 11/391,321

(22) Filed: Mar. 29, 2006

(65) Prior Publication Data

US 2006/0219736 A1 Oct. 5, 2006

Related U.S. Application Data

(60) Provisional application No. 60/669,014, filed on Apr. 7, 2005.

(30) Foreign Application Priority Data

Mar. 29, 2005 (FR) ..... 05 50790

(51) Int. Cl.
*B67D 5/56* (2006.01)

(52) U.S. Cl. ..... 222/129; 206/222; 220/521

(58) Field of Classification Search ..... 222/129; 206/219–222; 220/521–524; 215/6
See application file for complete search history.

(56) References Cited

U.S. PATENT DOCUMENTS 3,651,990 A 3/1972 Cernei
4,201,316 A 5/1980 Klingaman
4,203,517 A * 5/1980 Hildebrandt et al. ..... 206/221
6,045,254 A 4/2000 Inbar et al.
6,997,351 B2 * 2/2006 Cho ..... 222/82
7,347,322 B2 * 3/2008 Cho ..... 206/222
2003/0072850 A1 4/2003 Burniski

FOREIGN PATENT DOCUMENTS

DE 299 16 436 3/2001
JP 8-91418 * 4/1996
WO WO 2004/005154 A1 1/2004

* cited by examiner

*Primary Examiner*—Lien T Ngo
(74) *Attorney, Agent, or Firm*—Oblon, Spivak, McClelland, Maier & Neustadt, L.L.P.

(57) ABSTRACT

A device for placing in contact at least two products which are packaged separately in two compartments. The device includes a first compartment delineated by a container and a second compartment at least partially delineated by a body connected by an intermediate part to the container. The body is designed, in response to an actuating motion, to move from a first configuration or position, in which the two compartments are isolated from each other, to a second configuration or position enabling the compartments to communicate. The intermediate part is detachable relative to the container and includes a tubular channel configured to be placed in communication with the container. The body includes a sealing element around which is defined the second compartment, with this sealing element closing off the sealing container prior to the actuating motion.

32 Claims, 3 Drawing Sheets

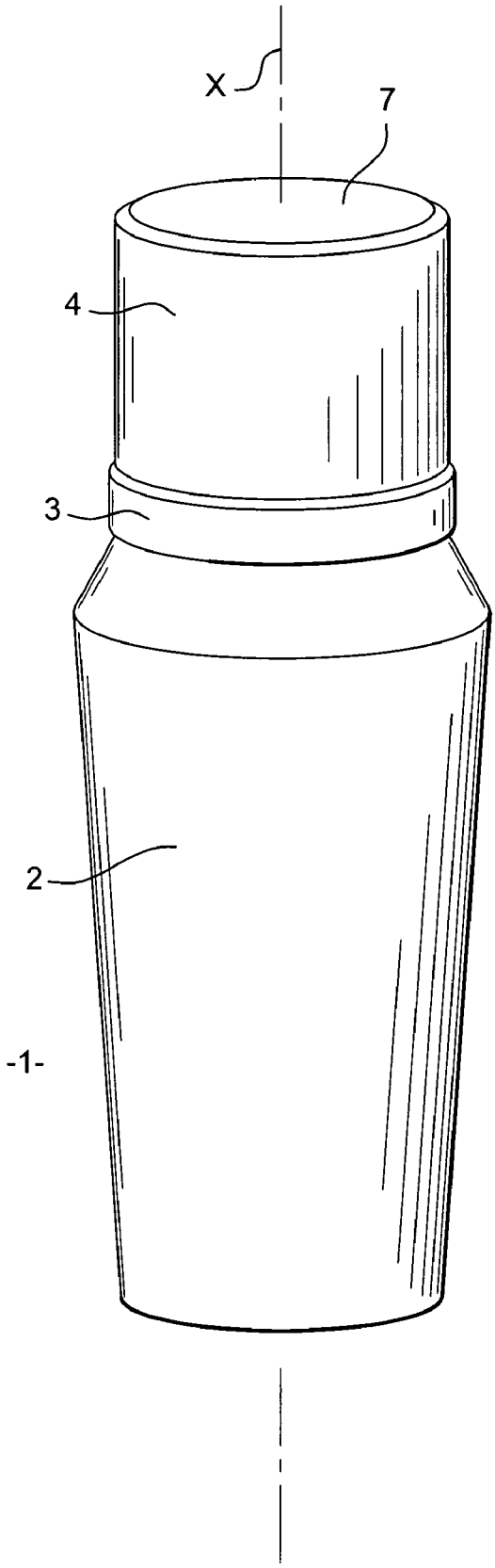
Fig. 1
Fig. 2
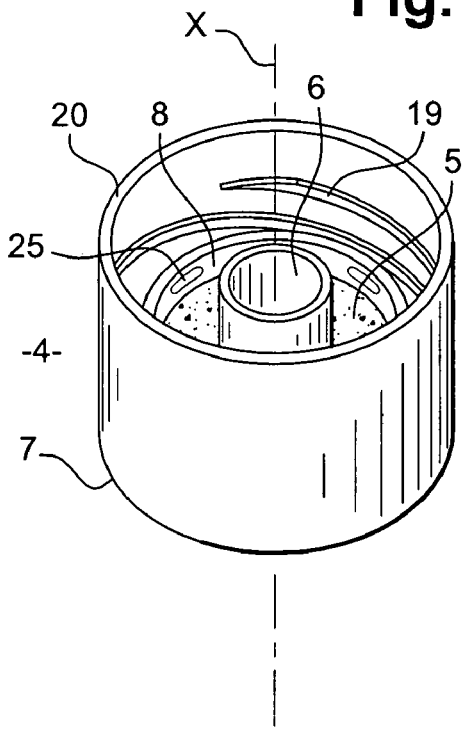

DEVICE FOR PLACING TWO PRODUCTS IN CONTACT

CROSS-REFERENCE TO RELATED APPLICATIONS:

This document claims priority to French Application Number 05 50790, filed Mar. 29, 2005 and U.S. Provisional Application No. 60/669,014, filed Apr. 7, 2005, the entire contents of which are hereby incorporated by reference.

FIELD OF THE INVENTION

The invention provides a device for placing at least two separately packaged products in contact with each other, and a system to dispense the composition obtained by mixing these two products. Preferably, the two products are cosmetic products. The invention can be particularly advantageous for substantially simultaneous or extemporaneous (for example, when use is desired) preparation and dispensing of a cosmetic formulation for hair treatment.

BACKGROUND OF THE INVENTION

Discussion of the Invention

The expression "cosmetic product" is understood to mean a product as defined in EC Council Directive 93/35/CEE dated 14$^{th}$ Jun. 1993.

In the field of hair coloring, the preparation of many coloring compositions involves the mixing of two products, generally a colorant and an oxidiz ing agent which, for reasons of stability, must be kept apart from each other until the moment of use of the coloring composition.

In the field of hair coloring, recent years have seen the appearance of mixing devices which, in a more or less automatic fashion, provide separate packaging of two products and extemporaneous mixing thereof at the moment of use of the coloring composition. Such systems are expensive and complicated to make. Leak tightness between the two compartments containing each of the products is difficult to achieve, in particular when the separation provided between these compartments takes the form of a film designed to be torn when the compartments are to be placed in communication. Moreover, it is sometimes difficult to find materials compatible with the products to be packaged due to the aggressive properties of at least some of these materials.

Arrangements are known in different fields in which various problems are experienced in dispensing the mixture of products obtained. U.S. Pat. No. 6,045,245 describes known ready-to-use feeding bottles incorporating two separate compartments. The body of these feeding bottles is not standard and includes an annular constriction some distance from the neck on which a teat can be mounted. A closure element is mounted on this body to engage with the annular constriction and to close a first compartment. This closure element defines the bottom of a second compartment. The problem posed by this type of feeding bottle stems from the fact that the two compartments are difficult to fill. U.S. Pat. No. 3,651,990 also discloses a known device of the type previously described, and which also presents problems with filling and closure of the second compartment.

DE 299 16 436 also describes a known device for extemporaneous mixing of two products, with the first product being held in a container and with the second product being held in isolation in a chamber of a closure element of the container. Mixing of the two products is obtained by simply sliding the closure element relative to the container. In effect, the chamber of the closure element is initially closed off by an intermediate mounting part of the closure element on the container, such that when the sliding movement takes place the chamber is opened and passages formed in this intermediate part allow the chamber to communicate with the container. The product flows through these passages from the chamber into the container, by gravity as the case may be.

This type of device poses a problem in that the passages formed to allow the product to flow prevent the product contained in said chamber from flowing out quickly and completely. In effect, these passages are formed between bridges of material connecting a blanking element on the intermediate part designed to close off the chamber to the means of attachment of this intermediate part in the neck of the container. The number of passages is identical to the number of material bridges, such that the flow of product leaving the chamber is divided into as many streams as there are passages. In practice, there is a risk that these passages will become blocked, and the mixture obtained may not then correspond to that expected by the user. The reliability and repeatability of mixtures obtained by such devices are not guaranteed or as satisfactory as desired.

SUMMARY OF THE INVENTION

Therefore, one of the objects of the present invention is to provide a device for separate packaging and combined dispensing of two products which resolves all or some of the aforementioned problems.

The invention provides a device for extemporaneously placing in contact at least two products packaged separately in respective first and second compartments.

In a preferred example, the first compartment is delineated by a container.

The second compartment is delineated at least partially by a body connected by an intermediate part to the container, with this body forming a closure element detachable from the container. In addition, the body is designed or arranged in response to an actuating motion, to move relative to the intermediate part from a first configuration or position in which the two compartments are isolated from each other to a second configuration or position enabling the compartments to communicate. Further, the intermediate part is detachable relative to the container and includes a tubular channel configured to be placed in communication with the container, with the body incorporating or having a sealing element around which is defined the second compartment. Also according to a preferred example, the sealing element includes a portion which, prior to the actuating motion, isolates the two compartments from each other in a leaktight manner.

Preferably, the portion of the sealing element is inserted into the tubular channel in a leaktight manner.

Advantageously, by way of example, the intermediate part can include a first fixing arrangement designed to engage with the container and a second fixing arrangement designed to engage with the closure element. In this case, the first fixing arrangement can form a snap-on attachment designed, in cooperation with the outer periphery of the container, to axially hold the intermediate part relative to the container. Optionally the first fixing arrangement can also be arranged or configured to immobilize the intermediate part in rotation relative to the container in engagement with the outer periphery of the container. By way of example, the second fixing arrangement can include a screw thread designed to engage with a counterpart screw thread presented by an external skirt on the closure element.

By way of example, the intermediate part can include a first and a second skirt respectively extending in opposite directions relative to a collar defined around the channel. In this case, the first skirt can support the first fixing arrangement and the second skirt can support second fixing arrangement.

Advantageously, according to an example embodiment, the intermediate part includes a first sealing skirt disposed inside the container and configured to ensure leaktight mounting of the intermediate part on the container. For example, the first sealing skirt can partly delineate the channel and engage with the portion of the sealing element in the first configuration.

Preferably, the intermediate part can include a second sealing skirt cooperating with the inner surface of a tubular wall delineating the second compartment. This second sealing skirt can present an internal cross-section larger than that of the sealing element, such that in the first configuration or position the second compartment is partly delineated by this second sealing skirt, the collar and the sealing element.

The second sealing skirt can be configured to engage with the tubular wall so as to identify or define a position of the closure element relative to the intermediate part corresponding to the second configuration. In particular, the tubular wall can include, for example, lugs designed to abut against an annular bead presented by the second sealing skirt in the second configuration.

By way of example, in a first embodiment, the container is made of glass, the intermediate part is made of a thermoplastic material and preferably of polyethylene, in particular high density polyethylene, and the closure element is made of a thermoplastic material and preferably of polypropylene.

The invention also provides a process for packaging a device according to the invention in which a container is filled with a first product. In addition, a body around a sealing element is separately filled with a second product. An intermediate part is mounted on the body so as to form a sealed unit, and the sealed unit is then mounted on the container.

The device according to the invention provides an advantageous packaging method in that the packaging of the first and second product can be performed on separate packaging lines independent of each other.

Advantageously, by way of example, according to one object of the invention, a packaging and dispensing device is provided that includes, on one hand, a device for contacting the two products as described and, on the other hand, a dispensing element designed to be mounted on the intermediate part when the closure element has been detached from the intermediate part to dispense a product mixture formed in the container.

For example, the dispensing element can include an outer enclosure to which is attached a pump surmounted by an actuating and dispensing arrangement. In particular, the outer enclosure can include a reversible arrangement for fixing the dispensing element on the intermediate part. By way of example, the dispensing element can include an immersion tube inserted into the tubular channel.

By way of example, the invention can be particularly advantageous in providing a unit for dispensing a cosmetic formulation obtained by extemporaneous mixing of two products held separately in the device.

The invention will be better understood upon reading the following description and by reference to the accompanying figures. These are given for guidance and by way of example only and are in no way limitative of the invention.

As should be apparent, the invention can provide a number of advantageous features and benefits. It is to be understood that, in practicing the invention, an embodiment can be constructed to include one or more features or benefits of embodiments disclosed herein but not others. Accordingly, it is to be understood that the preferred embodiments discussed herein are provided as examples and are not to be construed as limiting, particularly since embodiments can be formed to practice the invention that do not include each of the features of the disclosed examples.

BRIEF DESCRIPTION OF THE DRAWINGS

Examples of embodiments of the invention are illustrated in the drawings in which:

FIG. 1 is a profile or side view of a device according to an embodiment the invention in a first sealed configuration;

FIG. 2 is a perspective view of a closure element of a device according to the invention;

DETAILED DESCRIPTION OF THE PREFERRED EMBODIMENTS

Figure 3:
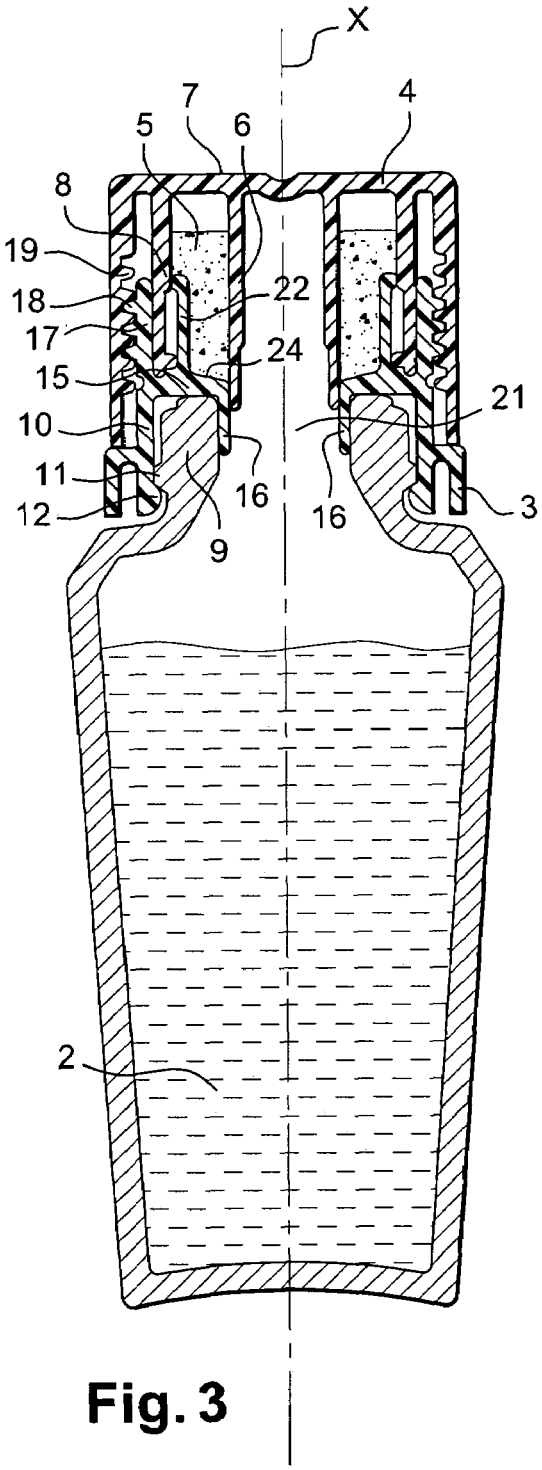
FIG. 3 is a lengthwise cross-sectional view of a device according to the invention in a first sealed configuration or position.

FIG. 1 shows an example of a device 1 according to the invention. The device includes a container 2 equipped with an intermediate part 3 surmounted by a closure element 4 for the container 2.

In this example, the container 2 is made of transparent glass and has a capacity of between 10 and 100 mL, and preferably in the order of 25 mL. The container 2 holds a first product P1, preferably a liquid. By way of example, the container 2 has a slightly tapered shape between its bottom and a shoulder at which is presented the intermediate part 3 and the closure element 4. As a variant, the container 2 can include a constriction situated some distance from the bottom and from the shoulder. In this case, the constriction is preferably positioned so that the transverse cross-section of the container at the shoulder is identical to, or superimposable upon, the transverse cross-section at the level of the bottom. Such containers have the advantage of being easy to convey on packaging lines.

In the illustrated example, closure element 4 delineates a chamber 5, shown in FIG. 2, around a sealing element 6 projecting from a bottom 7 of the closure element. The sealing element 6 stands perpendicular to the bottom 7 along an axis X.

The sealing element 6 can take the form of a hollow or solid stud. It defines a wall partly delineating the chamber 5, with the chamber 5 being defined around this sealing element 6.

In the example illustrated, chamber 5 is partly delineated by the bottom 7. It is delineated internally by the sealing element 6, and externally by a tubular wall 8 also standing on this bottom 7. The tubular wall 8 surrounds the sealing element 6. The tubular wall 8 also stands or extends perpendicular to the bottom 7 along the axis X. The chamber 5 is delineated between the sealing element 6 and the tubular wall 8, which can respectively be of any transverse cross-section.

The sealing element 6 is preferably a hollow tube, and it presents for example a circular external transverse cross-section. The tubular wall 8 presents for example a circular internal transverse cross-section, of a diameter greater than that of the sealing element 6, so that the tubular wall 8 and the sealing element 6 are defined in a concentric manner about the axis X. The chamber 5 then has an annular cross-section, by way of example.

Also by way of example, the chamber 5 has a capacity of between 1 and 20 mL, preferably on the order of 5 mL. The chamber 5 is designed to contain a second product P2 different from the first product P1. Preferably, the second product P2 is also liquid. For example, the invention can be particularly advantageous where the mixture of products P1 and P2 is not stable, and the products P1 and P2 are stored in isolation from each other so that the mixture is not made until the moment when it is desired to apply the mixture.

Figure 4:
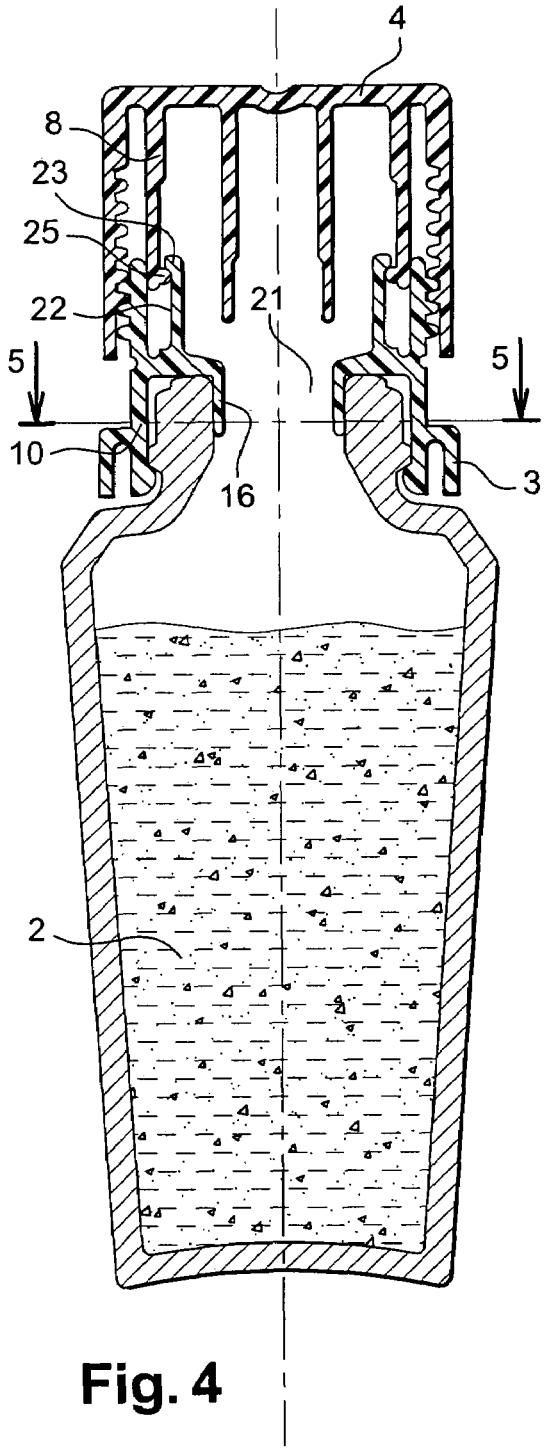
FIG. 4 is a lengthwise cross-sectional view of a device according to the invention in a second mixing configuration or position.
Figure 5:
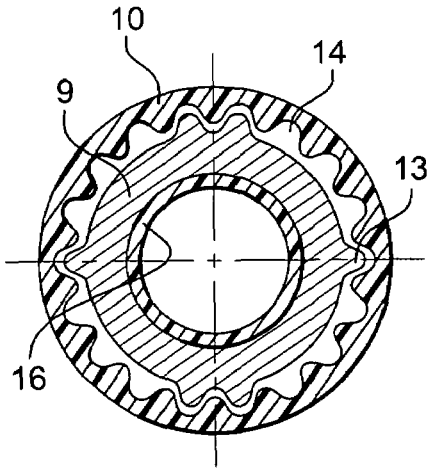
FIG. 5 is a transverse sectional view on the sectional plane referenced 5-5 in FIG. 4.
Figure 6:
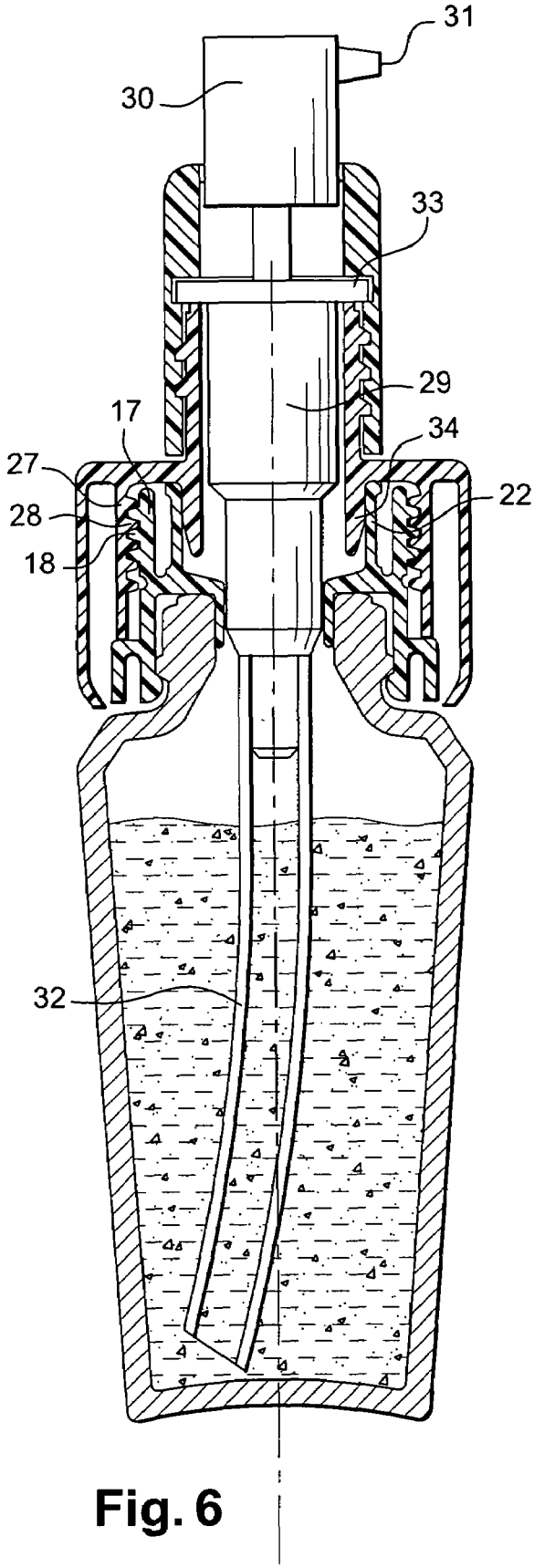
FIG. 6 is a lengthwise sectional view of a device according to an example of the invention fitted with a dispensing element.

The axis X corresponds to the lengthwise axis on which the cross-sections in FIGS. 3, 4 and 6 are drawn. In effect, the closure element 4 is provided to close off the container 2, and is mounted on this container so that the axis X is superimposed on a lengthwise axis and/or a rotational axis of symmetry of the container 2.

The chamber 5 is designed to be isolated from the contents of the container 2 in a first storage configuration or position in which the device 1 is closed. To this end, the intermediate part 3 enables the chamber 5 to be closed off in a first configuration or position. Given that the mounting of the closure element 4 on the intermediate part 3 is reversible, the user can place the intermediate part 3 in a second configuration or position relative to the closure element 4 in which the chamber 5 is no longer closed off. The closure element 4 is detachably mounted on the container 2.

Preferably, in the second configuration or position, the chamber 5 which is then open can be placed in communication with the contents of container 2. The second product P2 flows by gravity into the container 2 when the latter is resting on a flat surface so that the lengthwise axis X stands perpendicular to this surface.

In FIG. 3, the intermediate part 3 is mounted on a neck 9 of the container 2. The neck 9 delineates an opening in the container 2, with this opening being, for example, defined transversely relative to the axis X.

The intermediate part 3 includes a first skirt 10 presenting an arrangement for fixing the intermediate part 3 on the container 2. To this end, in the illustrated example, the outer periphery of the container 2, and in particular its neck 9, includes at least one lug 11 designed to engage by snap attachment with a counterpart bead 12 presented on an inner surface of the first skirt 10. The lug 11 is, for example, annular and the counterpart bead 12 takes the form, for example, of discontinuous segments evenly spaced on the inner surface of the first skirt 10.

The purpose of this engagement is to axially immobilize the intermediate part 3 relative to the container 2. Preferably, this snap attachment is designed so that it is arranged not to allow manual detachment from the intermediate part 3 of the container 2 in normal conditions of use.

In addition, to immobilize the intermediate part 3 in rotation relative to the container 2, the first skirt 10 includes at its inner surface a projection designed to engage with projections on the outer periphery of the neck 9. In the illustrated example, the neck 9 includes at least one lengthwise rib 13 designed to engage with any one of counterpart grooves 14 provided on the inner surface of the first skirt 10. In effect, the inner surface of this first skirt 10 presents a continuous series of grooves such as 14 designed to engage with the rib 13 so that the intermediate part 3 can be mounted on the container 2 without having to index their respective positions when they are placed in engagement.

In particular, to distribute the forces that will inevitably be applied on these grooves 14 when the closure element 4 is caused to rotate relative to the intermediate part 3, the neck 9 preferably includes a second diametrically opposing rib, plus two sets of two adjacent ribs arranged respectively in an angular position of 90° relative to the first rib 13. Before the unit formed by the closure element 4 and the intermediate part 3 is mounted on the container 2, the grooves 14 also facilitate manipulation of the closure element 4, in particular so that it can be mounted on the intermediate part 3.

The intermediate part 3 is mounted on the container in a leaktight manner. To this end, it includes a collar 15 from which extends the first skirt 10. This collar 15 is configured to bear against a rim of the opening formed by the neck 9. For example, the intermediate part 3 can include a first sealing skirt 16 concentric with the first skirt 10 and also extending from this collar 15 so as to make leaktight contact with the inner periphery of the neck 9.

To facilitate mounting of the intermediate part 3 on the container 2, it is preferably made of a thermoplastic material such as polyethylene, in particular high density polyethylene. It can be formed, for example, by injection moulding.

To facilitate mounting of the closure element 4 on the container 2, the closure element 4 is mounted on the intermediate part 3. To this end, the intermediate part 3 includes a second skirt 17 extending from the collar 15 in a direction opposite the first skirt 10. This second skirt 17 presents a fixing arrangement designed to reversibly engage with the closure element 4. In particular, the second skirt 17 presents a screw thread 18 on its outer periphery designed to engage with a counterpart screw thread 19 on an external mounting skirt 20 of the closure element 4.

The mounting skirt 20 surrounds the tubular wall 8 so that the second skirt 17 is located between the mounting skirt 20 and the tubular wall 8 when the closure element 4 is mounted on the intermediate part 3.

In the first configuration or first position, in which the intermediate part 3 closes off the chamber 5, a face 24 of the collar 15 opposite that bearing against the rim of the neck 9 closes the chamber 5 in an annular manner. In the illustrated example, in this first configuration or position, the sealing element 6 is partially inserted in a leaktight manner into the channel 21 laterally defined by the first sealing skirt 16.

When it is open, the channel 21 can allow communication between the chamber 5 and the inside of the container 2, thereby enabling the products respectively contained therein to mix. The engagement between the sealing element 6 and the first sealing skirt 16 ensure leaktight closure of this channel 21, and therefore also leaktight closure of container 2 in this example.

Furthermore, to ensure leaktight closure of the chamber 5, the intermediate part 3 additionally includes a second sealing skirt 22 designed to engage in a leaktight manner, in the first position, with the inner surface of the tubular wall 8. In effect, the second sealing skirt 22 includes a bead 23 on its outer periphery designed to come into contact with the tubular wall 8 and to form an annular seal by mechanical contact.

Thus leaktight closure of the chamber 5 is assured, on the one hand, by the contact between the sealing element 6 and the first sealing skirt 16 and, on the other hand, by the contact between the bead 23 and the tubular wall 8. In this first configuration, the products P1 and P2 are isolated from each other.

The device can be arranged such that, when the user of device 1 wishes to mix these two products, the user moves the closure element 4 to a second configuration or position in which the channel 21 is opened. To do this, the closure element 4 is caused to slide by unscrewing along the axis X relative to the intermediate part 3 which remains integral with the container 2. By this movement of the closure element 4, the sealing element 6 and the tubular wall 8 are automatically moved the same distance along the axis X. When the user initiates the unscrewing action, the seal between the second sealing skirt 22 and the tubular wall 8 is not broken, such that the unscrewing action does not lead to depressurisation of the chamber 5.

Once the seal between the first sealing skirt 16 and the sealing element 6 is broken, the product distributed in an annular manner around this sealing element 6 flows in a convergent stream through the channel 21. Given that the channel 21 is delineated by the first sealing skirt 16 abutting against the inner surface of the neck 9, the channel 21 allows a flow of product substantially identical to the maximum flow permitted via this neck 9.

In addition, the face 24 of the collar 15 partly delineating the chamber 5 presents a tapered surface in this example so as to facilitate convergence of the flow towards the channel 21.

As the time taken for the product P2 to flow into the container 2 depends on the nature and the quantity of this product P2, provision is made to hold the closure element 4 on the intermediate part 3 in the second configuration for a sufficient length of time to ensure that all of the product P2 is emptied into the container 2. Furthermore, this second configuration of the device 1 is designed to allow the unit to be shaken to homogenize the mixture with no risk of the mixture spilling out of the device. To this end, the user can be illustrated to not fully unscrew the closure element so that it is left in this second configuration or position.

A sensing arrangement or device or a stop, can be provided to identify this second configuration. Thus, when the unscrewing action has brought the device into a position substantially corresponding to the second configuration, a holding point of engagement is provided between the intermediate part 3 and the closure element 4. For example, as illustrated in FIG. 4, this hold point can be obtained or identified during the unscrewing motion by the abutment of a lug 25 presented on the inner surface of the tubular wall 8 against the bead 23 provided on the outer periphery of the second sealing skirt 22. In particular, the tubular wall 8 includes four evenly spaced lugs. In the first instance the user is invited or instructed not to unscrew the device beyond this hold point, and to shake the unit to improve mixing of the products.

In this second configuration, the closure element 4 is still mounted on the intermediate part 3, but the contact between the lug(s) 25 and the bead 23 is not leaktight. Even with this absence of sealing, the risk of ejection or leakage of product is small or non-existent in the recommended conditions of use and manipulation of the device 1.

Once the mixture is made, and to enable the mixture to be dispensed, the user removes the closure element 4 by continuing the unscrewing action beyond the hold point. Preferably the closure element 4 is made of a more rigid material than the intermediate part 3. For example the closure element 4 can be made of a thermoplastic material such as polypropylene, so as to ensure a good radial fit on the intermediate part 3. It is obtained by injection moulding for example. Preferably, to facilitate handling and manual rotation of the closure element, the latter presents a ridged outer surface.

When the closure element 4 is detached from the container 2, the intermediate part 3 is left on the container 2 so as to form a support to receive a dispensing element 26, as shown, for example, in FIG. 6.

The dispensing element 26 includes an outer enclosure 27 incorporating a threaded skirt 28 designed to screw onto the thread 18 provided on the second skirt 17 of the intermediate part. The dispensing element 26 supports a pump body 29, with the pump body 29 being surmounted by a push button 30. The push button 30 forms an actuating element for the pump body 29. It presents a dispensing aperture 31 through which the product mixture can be expelled in the illustrated example.

Actuation of the push button 30 is obtained by pressing down along the lengthwise axis X. The pump body 29 is for example fitted with an immersion tube 32, the latter then extending through the channel 21 inside the container 2.

Preferably, the dispensing element 26 is mounted in a leaktight manner on the container 2. By way of example, a cup 33 surrounding the pump body 29 is held in a leaktight manner inside the outer enclosure 27. Furthermore, the outer enclosure 27 presents an inner tubular skirt around the pump body 29 designed to bear in a leaktight contact against the inner surface of the second sealing skirt 22 of the intermediate part 3.

The dispensing element 26 is detachably mounted on the container 2. Thus when the container 2 is empty and the whole of the mixture has been dispensed, the dispensing element 26 can be detached for subsequent mounting on another device such as 1.

The manufacturing process for a device 1 is simple and ensures separation between the products P1 and P2 at all times. Thus, the product P2 is placed in the chamber 5, for example, with the closure element 4 being disposed so that the bottom 7 is resting on a flat surface. The intermediate part 3 is then screwed onto the closure element 4 so as to close off the chamber 5. Once this chamber 5 is closed off, the closure element 4 and the intermediate part 3 form a sealed unit which can be handled without risk of leakage. The first product P1 can then be introduced into the container 2, and, the sealed unit is then clamped onto the neck 9 of the container 2 thereby closing it off. The device 1 according to the invention is then complete. It is in its first configuration or position.

Preferably, the device 1 is used to package two products capable of being combined to form a cosmetic formulation, in particular for hair treatment.

Throughout the description, the expressions such as "including one," "having," "has," or "comprising" should be regarded as synonymous with "including at least one", unless otherwise specified.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters Patent of the United States is:

1. A device for placing at least two products packaged separately in contact with each other, comprising:

a first compartment which is at least partially delineated by a container, a second compartment which is at least partially delineated by a body connected by an intermediate part to the container, wherein the body forms a closure element which is detachable from the container, wherein the body is arranged, in response to an actuating motion, to move relative to the intermediate part from a first position in which the first and second compartments are isolated from each other to a second position which allows the first and second compartments to communicate with each other, and wherein the intermediate part is detachable relative to the container and includes a tubular channel configured to be placed in communication with the container, wherein the body includes a bottom wall, a sealing element that projects from the bottom wall and a tubular wall that projects from the bottom wall so as to surround the sealing element in a radial direction of the body, wherein an inner periphery of the second compartment in the radial direction of the body is formed by an external surface of the sealing element and an outer periphery of the second compartment in the radial direction of the body is at least partly delineated by an internal surface of the tubular wall, and wherein the sealing element includes a portion which, prior to said actuating motion, isolates the first and second compartments from each other in a leaktight manner.

2. A device according to claim 1, wherein the portion of the sealing element is inserted into the tubular channel in a leaktight manner.

3. A device according to claim 1, wherein the intermediate part includes first fixing means arranged to engage with the container and second fixing means designed to engage with the closure element.

4. A device according to claim 3, wherein the first fixing means includes snap-on attachment means which cooperate with the outer periphery of the container to axially hold the intermediate part relative to the container.

5. A device according to claim 3, wherein the first fixing means include means to immobilize the intermediate part in rotation relative to the container in engagement with the outer periphery of the container.

6. A device according to claim 3, wherein the second fixing means includes a screw thread designed to engage with a counterpart screw thread presented by an external skirt on the closure element.

7. A device according to claim 3, wherein the intermediate part includes a first skirt and a second skirt respectively extending in opposite directions relative to a collar defined around the channel.

8. A device according to claim 7, wherein the first skirt supports the first fixing means and the second skirt supports second fixing means.

9. A device according to claim 1, wherein the intermediate part includes a first sealing skirt disposed inside the container and configured to ensure leaktight mounting of the intermediate part on the container.

10. A device according to claim 9, wherein the first sealing skirt partly delineates the channel and engages with the portion of the sealing element in the first position.

11. A device according to claim 10, wherein the intermediate part includes a second sealing skirt cooperating with the inner surface of the tubular wall delineating the second compartment, wherein the second sealing skirt has an internal cross-section larger than that of the sealing element, such that in the first position the second compartment is at least partly delineated by the second sealing skirt, a collar of the intermediate part, and the sealing element.

12. A device according to claim 11, wherein the second sealing skirt is arranged to engage with said tubular wall to identify a position of the body relative to the intermediate part corresponding to the second position.

13. A device according to claim 12, wherein the tubular wall includes lugs arranged to abut against an annular bead associated with the second sealing skirt in the second configuration.

14. A device according to claim 1, wherein the container is made of glass.

15. A device according to claim 14, wherein the intermediate part is made of a thermoplastic material.

16. A device according to claim 15, wherein the intermediate part is made of high density polyethylene.

17. A device according to claim 15, wherein the closure element is made of a thermoplastic material.

18. A device according to claim 17, wherein the closure element is made of polypropylene.

19. A device according claim 1, in combination with a dispensing element to dispense a product mixture held in the container that results from bringing the at least two products in contact with each other, wherein said dispensing element is arranged to be mounted on the intermediate part when the closure element has been detached from the intermediate part, and wherein said device and said dispensing element form a unit.

20. A unit according to claim 19, wherein the dispensing element includes an outer enclosure to which is attached a pump surmounted by an actuating and dispensing device.

21. A unit according to claim 20, wherein the dispensing element includes an immersion tube inserted into the tubular channel.

22. A unit according to claim 21, wherein the outer enclosure includes reversible means of fixing the dispensing element on the intermediate part.

23. A unit according to claim 19, wherein the at least two products include first and second products that are respectively contained in the first and second compartments, and wherein the first and second products are cosmetic products or components of cosmetic products.

24. A process for packaging a device according to claim 1, comprising:

filling the container with a first product, separately filling the body around the sealing element with a second product, mounting the intermediate part on the body so as to form a sealed unit, and mounting the sealed unit on the container.

25. A device according to claim 1, wherein said tubular wall cooperates with a sealing skirt of said intermediate part to form the outer periphery of said second compartment.

26. A device according to claim 25, wherein said sealing element of said body is in contact with said intermediate part in said first position.

27. A device according to claim 25, wherein in said first position said sealing skirt of said intermediate part is radially between said tubular wall and said sealing element of said body.

28. A device according to claim 27, wherein said intermediate part includes a skirt to which said body is removably mountable, and wherein in said first position said tubular wall of said body is radially between said skirt of said intermediate part and said sealing skirt of said intermediate part.

29. A device according to claim 1, wherein the sealing element is a hollow tube.

30. A device according to claim 1, wherein the sealing element includes a circular external transverse cross-section.

31. A device according to claim 30, wherein the tubular wall includes a circular internal transverse cross-section of a diameter greater than that of the circular external transverse cross-section of the sealing element such that the tubular wall is arranged concentrically around the sealing element.

32. A device according to claim 1, wherein the second compartment includes an annular cross-section that is internally defined by the external surface of the sealing member and externally defined by the internal surface of the tubular wall.

* * * * *